US012264659B2

(12) United States Patent
Fontanesi et al.

(10) Patent No.: US 12,264,659 B2
(45) Date of Patent: Apr. 1, 2025

(54) PISTON ASSEMBLY

(71) Applicant: Dana Motion Systems Italia S.R.L., Reggio Emilia (IT)

(72) Inventors: Luca Fontanesi, Reggio Emilia (IT); Alessandro Sassi, Reggio Emilia (IT); David Gambuzzi, Reggio Emilia (IT)

(73) Assignee: DANA MOTION SYSTEMS ITALIA S.R.L., Reggio Emilia (IT)

( * ) Notice: Subject to any disclaimer, the term of this patent is extended or adjusted under 35 U.S.C. 154(b) by 0 days.

(21) Appl. No.: 18/500,912

(22) Filed: Nov. 2, 2023

(65) Prior Publication Data

US 2024/0151216 A1 May 9, 2024

(30) Foreign Application Priority Data

Nov. 3, 2022 (DE) ..... 20 2022 106 185.8

(51) Int. Cl.

| | |
|---|---|
| ***F04B 1/295*** | (2020.01) |
| ***F04B 1/124*** | (2020.01) |
| ***F04B 1/143*** | (2020.01) |
| ***F04B 53/16*** | (2006.01) |

(52) U.S. Cl.

CPC ..... *F04B 1/143* (2013.01); *F04B 1/124* (2013.01); *F04B 1/295* (2013.01); *F04B 53/162* (2013.01)

(58) Field of Classification Search

CPC ..... F04B 1/295; F04B 1/324; F04B 49/12; F04B 53/162

USPC ..... 91/505, 506

See application file for complete search history.

(56) References Cited

U.S. PATENT DOCUMENTS

| | | | | |
|---|---|---|---|---|
| 5,226,349 | A * | 7/1993 | Alme | F04B 1/324 91/506 |
| 6,553,891 | B2 * | 4/2003 | Fiebing | F04B 1/324 91/506 |
| 7,380,492 | B2 * | 6/2008 | Thoms | F04B 1/324 92/13 |
| 8,074,558 | B2 * | 12/2011 | Knussman | F01B 3/102 92/12.2 |
| 8,677,886 | B2 * | 3/2014 | Cronin | F15B 11/0365 91/505 |
| 9,803,660 | B1 * | 10/2017 | Hansell | F04B 1/324 |
| 11,268,499 | B2 * | 3/2022 | Chmatil | F04B 1/324 |
| 11,608,825 | B2 * | 3/2023 | Kharpas | F04B 1/122 |
| 2024/0151225 | A1 * | 5/2024 | Fontanesi | F04B 1/2042 |

* cited by examiner

*Primary Examiner* — Michael Leslie
(74) *Attorney, Agent, or Firm* — McCoy Russell LLP

(57) ABSTRACT

The present disclosure relates to a piston assembly, the piston assembly comprising a cylinder extending along an axis and having an open axial end, a cap assembly closing the cylinder at its open axial end, wherein the cap assembly comprises an insertion portion received in the cylinder at its open axial end, and a piston axially movably disposed within the cylinder and partially received in the insertion portion of the cap assembly. The present disclosure further relates to a variable displacement hydraulic unit including said piston assembly.

16 Claims, 11 Drawing Sheets

PISTON ASSEMBLY

CROSS-REFERENCE TO RELATED APPLICATION

The present application claims priority to German Utility Model Application No. 20 2022 106 185.8, entitled "PISTON ASSEMBLY", and filed on Nov. 3, 2022. The entire contents of the above-listed application is hereby incorporated by reference for all purposes.

TECHNICAL FIELD

The present disclosure relates to a piston assembly and to a variable displacement hydraulic unit including the piston assembly. The variable displacement hydraulic unit may include a variable displacement hydraulic pump or a variable displacement hydraulic motor, for example.

BACKGROUND AND SUMMARY

Hydraulic piston assemblies including a cylinder and a piston movably disposed within the cylinder are widely used in the art of hydraulic devices. In some cases, the cylinder may be open at one end and is closed or sealed off at its open end by a cap assembly. For example, during assembly the cylinder may be kept open for some time and may close its open end by putting on the cap assembly only at a later stage.

Known piston assemblies of this sort typically require additional seals such as sealing rings to seal the cap assembly. These seals are usually mounted on the cylinder. For example, a cylinder wall enclosing the cylinder may include an annular groove or indentation, and a sealing ring may be disposed or received in the groove or indentation formed in the cylinder wall. However, producing a piston assembly including seals of the aforementioned type is often complex and expensive.

Thus, there is demand for a piston assembly including a cylinder and a cap assembly closing the cylinder at an axial end thereof which can be produced simply and at low cost.

This demand is met by a piston assembly including the features described herein and by a variable displacement hydraulic unit including said piston assembly.

The presently proposed piston assembly comprises at least:

- a cylinder extending along an axis and having an open axial end,
- a cap assembly closing the cylinder at its open axial end, the cap assembly comprising an insertion portion received in the cylinder at its open axial end, and
- a piston axially movably disposed within the cylinder and partially or at least partially received in the insertion portion of the cap assembly.

As the cap assembly includes an insertion portion which is received in the cylinder, one or more seals may be mounted on the insertion portion. For instance, a cylinder wall enclosing the cylinder may then not need to include additional machined portions such as grooves or indentations for mounting the seals on the cylinder wall. The fact that the piston is partially or at least partially received in the insertion portion of the cap assembly may render the cap assembly stable.

The piston assembly may comprise a housing. The cylinder may be formed in the housing. The cap assembly may then be fixed or axially fixed to the housing.

The piston assembly may comprise a hydraulic chamber formed axially in between the cap assembly and the piston, wherein a hydraulic pressure in the hydraulic chamber is configured to bias the piston in a first direction along the axis.

A cylinder wall enclosing the cylinder may have a cylindrical shape and may include no machined portion or portions in or on the cylinder wall.

The cap assembly may comprise an outer sealing member disposed radially in between the insertion portion of the cap assembly and a cylinder wall enclosing the cylinder. The outer sealing member may be mounted on the insertion portion of the cap assembly. For example, a radially outer surface of the insertion portion of the cap assembly may comprise an outer annular indentation. The outer sealing member may then be received in the outer annular indentation.

The cap assembly may comprise an inner sealing member disposed radially in between the insertion portion of the cap assembly and the piston. The inner sealing member may be mounted on the insertion portion of the cap assembly. For example, a radially inner surface of the insertion portion of the cap assembly may comprise an inner annular indentation. The inner sealing member may be received in the inner annular indentation.

The piston assembly may comprise a first biasing member for biasing the piston in a first direction along the axis. The piston assembly may comprise an axially displaceable zeroing member limiting axial movement of the first biasing member. The first biasing member may be axially supported on the cap assembly. The piston assembly may further comprise a second biasing member for biasing the piston in a second direction along the axis, opposite to the first direction. For example, the zeroing member may be configured to limit axial movement of the first biasing member in a first direction along the axis and to limit axial movement of the second biasing member in a second direction along the axis, opposite to the first direction.

The piston may comprise a body portion and a protrusion extending from the body portion in a lateral direction perpendicular to the axis. The first biasing member may be configured to be axially supported on the protrusion and to bias the piston in the first axial direction when at least a portion of the protrusion extends beyond the zeroing member in the second axial direction. Additionally or alternatively, the second biasing member may be configured to be axially supported on the protrusion and to bias the piston in the second axial direction when at least a portion of the protrusion extends beyond the zeroing member in the first axial direction. An axial extension of the protrusion may be equal to an axial extension of the zeroing member.

The piston assembly may comprise a first thrust ring axially disposed in between the zeroing member and the first biasing member and in between the protrusion and the first biasing member. The first biasing member may be configured to be supported on the protrusion via the first thrust ring and to move the piston in the first direction until the first thrust ring hits the zeroing member. Additionally or alternatively, the piston assembly may comprise a second thrust ring axially disposed in between the zeroing member and the second biasing member and in between the protrusion and the second biasing member. The second biasing member may be configured to be supported on the protrusion via the second thrust ring and to move the piston in the second direction until the second thrust ring hits the zeroing member.

The first biasing member and/or the second biasing member may at least partially enclose the piston.

The piston assembly may comprise a rotatable gudgeon including an eccentric pin engaged with the zeroing member so that the zeroing member is displaceable along the axis by rotating the rotatable gudgeon.

The piston assembly may comprise a worm screw or leadscrew engaged with the zeroing member so that the zeroing member is displaceable along the axis by rotating the worm screw or leadscrew.

The presently proposed variable displacement hydraulic unit comprises a swashplate, and the above-described piston assembly, wherein the piston is coupled to the swashplate for rotating the swashplate.

Embodiments of the presently proposed subject matter are illustrated in the accompanying drawing and are described in the following detailed description.

DETAILED DESCRIPTION

Figure 1:
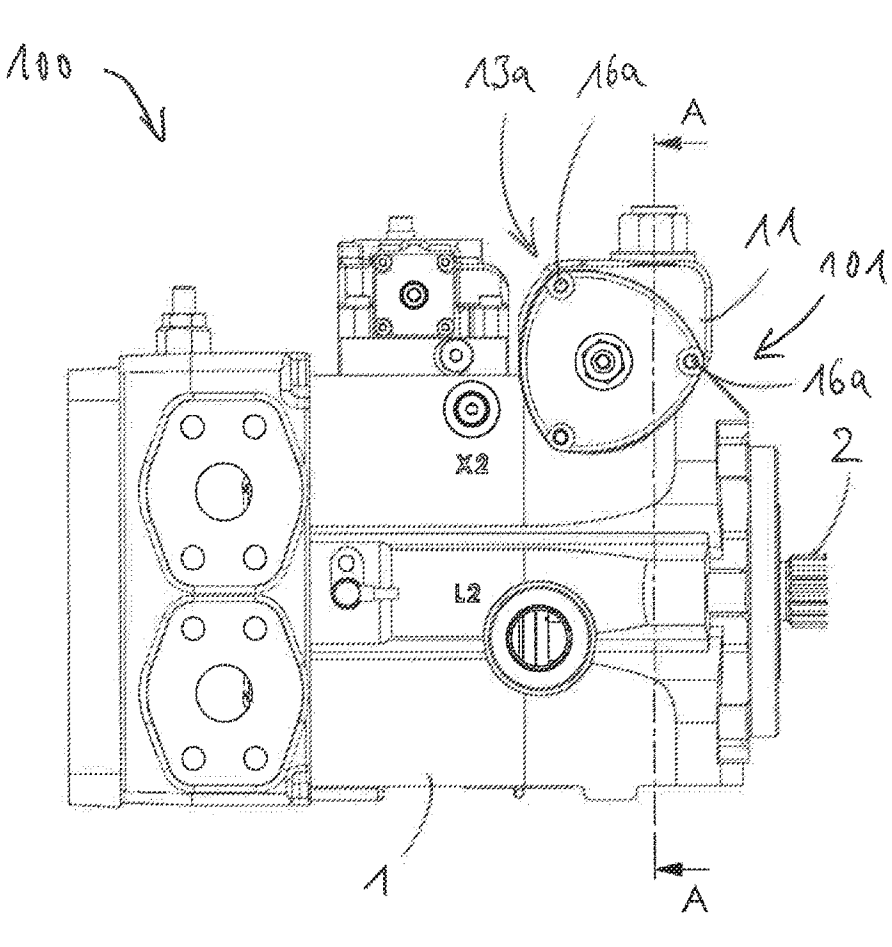
FIG. 1 schematically illustrates a plan view of a first embodiment of a variable displacement hydraulic unit including a piston assembly of the presently proposed type.
Figure 3:
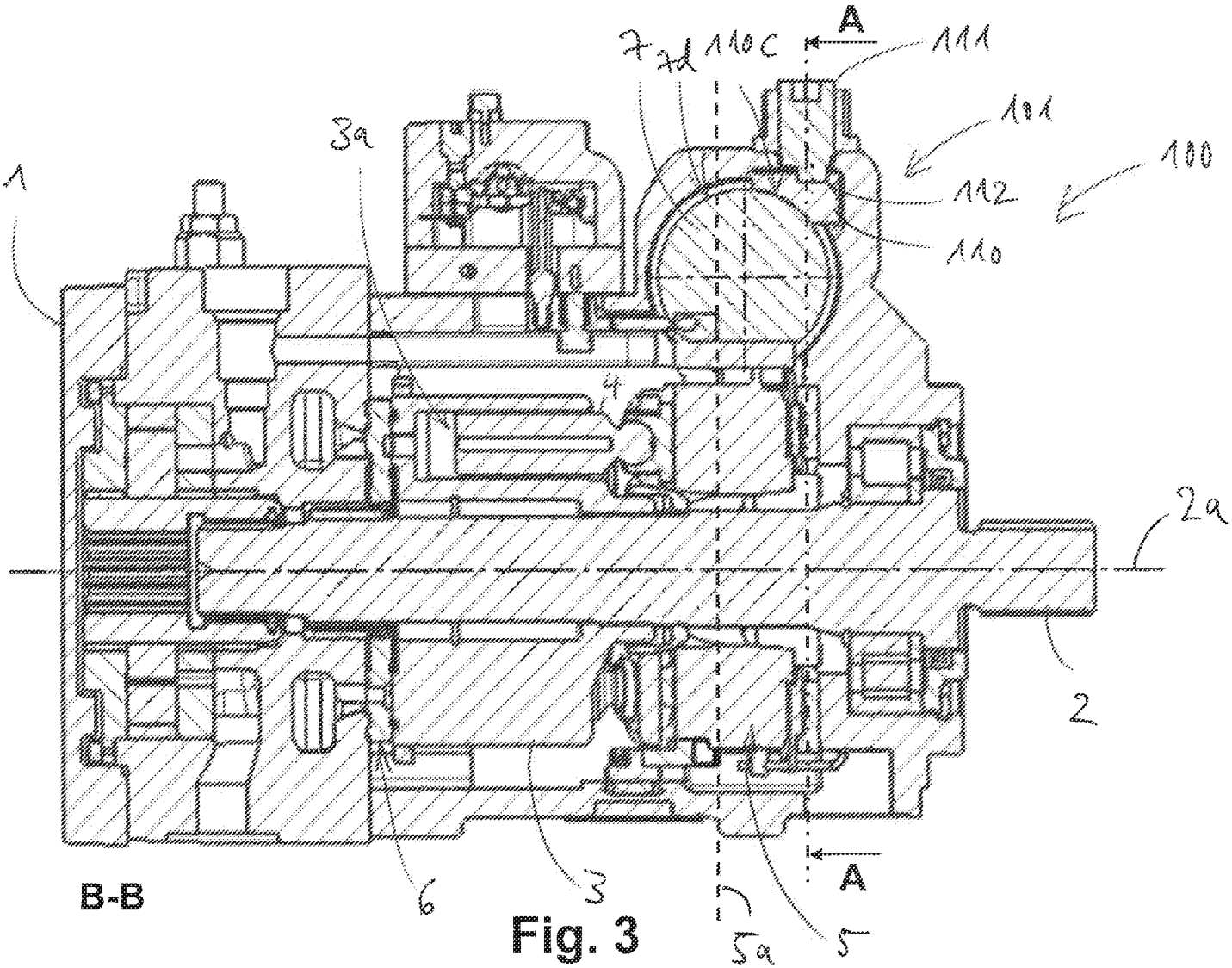
FIG. 3 schematically illustrates a second sectional view of the variable displacement hydraulic unit of FIG. 1
Figure 4:
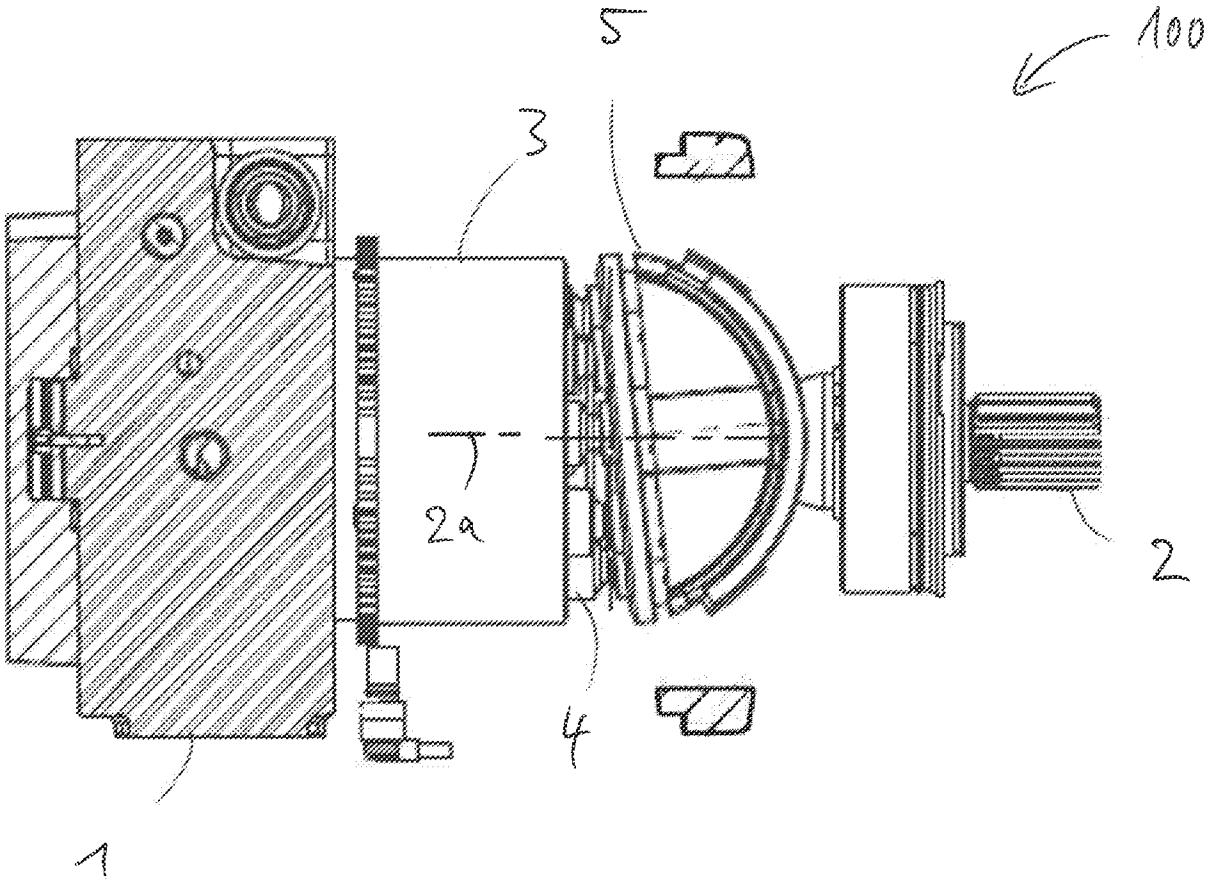
FIG. 4 schematically illustrates a plan view of elements the variable displacement hydraulic unit of FIG. 1, wherein a swashplate is in a tilted position.

FIG. 1 shows a plan view of a variable displacement hydraulic unit 100 of the presently proposed type according to a first embodiment. Here, the variable displacement hydraulic unit 100 is a variable displacement axial piston unit and may be used as a hydraulic pump or as a hydraulic motor. FIGS. 2 to 8 show various views of the hydraulic unit 100 of FIG. 1, wherein here and in all of the following, features recurring in different figures are designated with the same or similar reference signs. In FIG. 1, a dashed line A-A indicates the sectional plane of FIG. 2. And in FIG. 2, a dashed line B-B indicates the sectional plane of FIG. 3. The viewing direction of FIG. 4 is perpendicular to the viewing direction of FIG. 2 and perpendicular to the viewing direction of FIG. 3.

The hydraulic unit 100 includes a casing 1, a rotatable shaft 2 such as pump shaft or motor shaft at least partially disposed in the casing 1, a cylinder block 3 (see FIG. 3) rotationally coupled to the shaft 2, pistons 4 configured to reciprocate within cylinders 3*a* formed in the cylinder block 3, and a tiltable swashplate 5 (see FIGS. 3 and 4) configured to control a stroke of the pistons 4, as is generally known in the art of hydraulic devices. A rotation axis 5*a* of the swashplate 5 is arranged perpendicular to a rotation axis 2*a* of the rotatable shaft 2. The cylinders 3*a* are fluidically connected to a fluid inlet and to a fluid outlet, for example via a valve plate 6. Within the scope of this document the term fluid may include a liquid such as oil.

The hydraulic unit 100 further includes a piston assembly 101. More detailed views of the piston assembly 101 are depicted in FIGS. 5 to 8, for example. The piston assembly 101 includes a piston 7, for example a servo piston, movable along an axis 8 and mecanically coupled to the swashplate 5, biasing members 9*a*, 9*b* for biasing the piston 7 along the axis 8, and an axially displaceable zeroing member 110 configured to limit axial movement of the biasing members 9*a*, 9*b*. The piston 7 may move or may be moved in a first direction 8*a* along the axis 8 and in a second direction 8*b* along the axis 8, wherein the first axial direction 8*a* and the second axial direction 8*b* point in opposing directions along the axis 8. The piston 7 is configured to control a swivel angle of the swashplate 5 for controlling the stroke of the pistons 4. Here, the biasing member 9*a*, 9*b* are configured as helical compression springs.

In the embodiment depicted here, movement of the piston 7 along the axis 8 is controllable via hydraulic forces. When no net hydraulic force acts on the piston 7 along the axis 8, the biasing members 9*a*, 9*b* move the piston 7 back to a zero position. Ideally, in the zero position of the piston 7 the swashplate 5 is arranged perpendicular to the rotation axis 2*a* of the shaft 2 so that a stroke of the pistons 4 vanishes. Or in other words, when the piston 7 is in the zero position, the hydraulic unit 100 should be in a neutral configuration in which it does not displace fluid upon rotation of the shaft 2. However, due to manufacturing tolerances and/or mechanical wear the zero position of the piston 7 may not always exactly correspond to the neutral configuration of the hydraulic unit 100. Therefore, in order to make sure that the hydraulic unit 100 is in the neutral configuration when the piston 7 is in the zero position, the zero position of the piston 7 can be set or adjusted by displacing the zeroing member 110 along the axis 8, as will be explained in further detail below.

Figure 2:
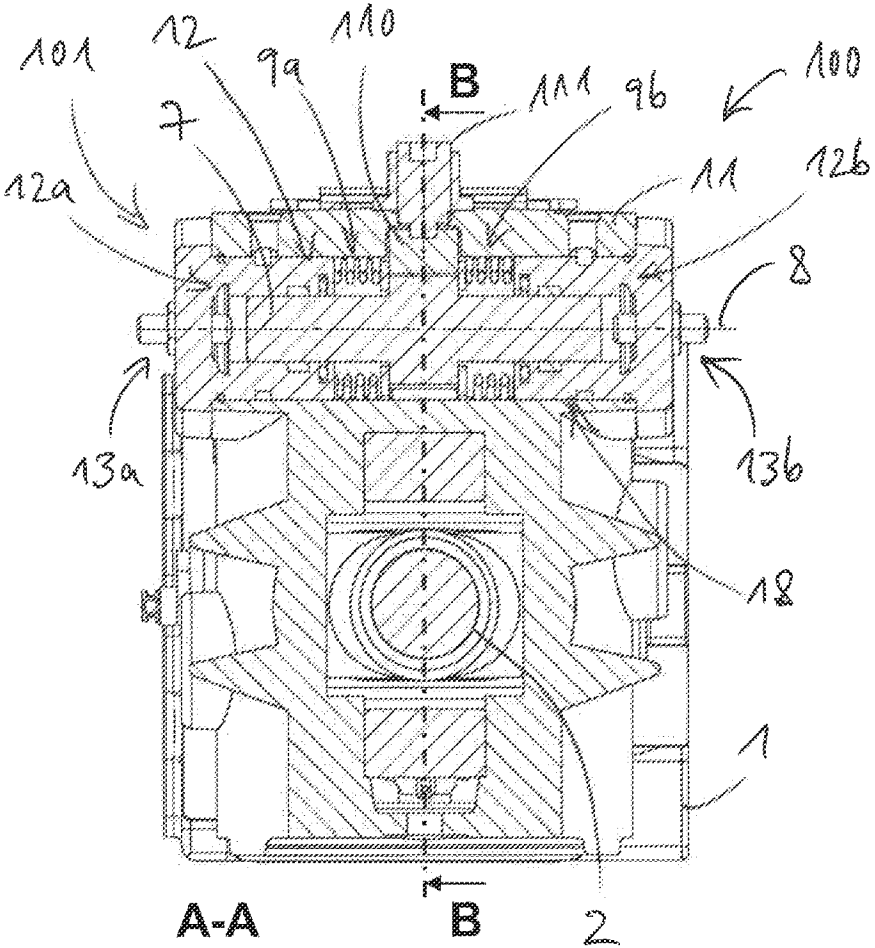
FIG. 2 schematically illustrates a first sectional view of the variable displacement hydraulic unit of FIG. 1.
Figure 5:
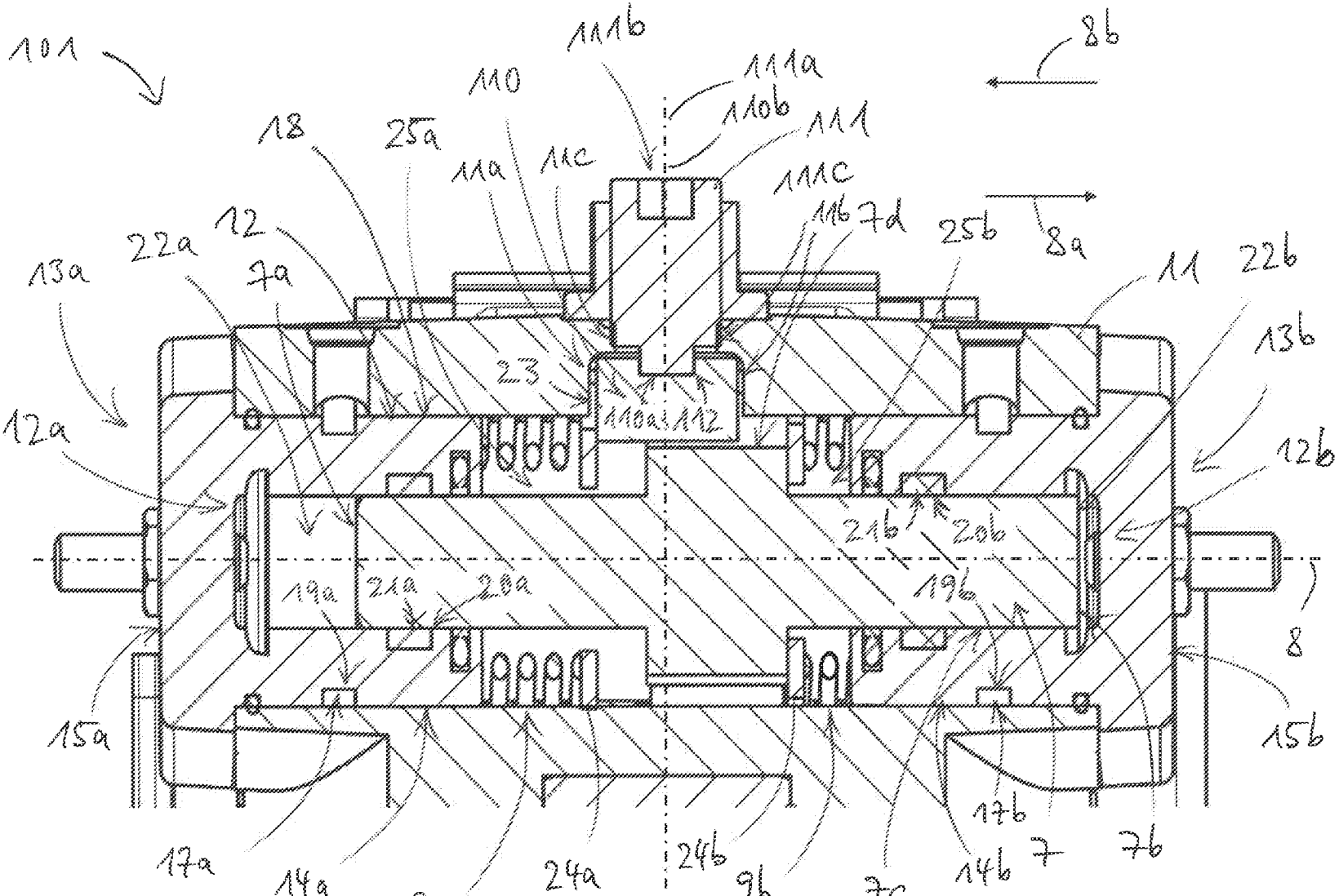
FIG. 5 illustrates a sectional view of the variable displacement hydraulic unit of FIGS. 1 to 4, wherein a piston of the piston assembly is deflected from a first zero position.

FIG. 5 shows a detail of FIG. 2. Specifically, FIG. 5 shows a sectional view of the piston assembly 101 of the hydraulic unit 100. The piston assembly 101 includes a housing 11. Here, the housing 11 of the piston assembly 101 is formed in one piece with the casing 1 enclosing the shaft 2 and the cylinder block 3. In alternative embodiments not explicitly depicted here, the housing 11 of the piston assembly 101 and the casing 1 may possibly be separate elements which may be connected to one another. The housing 11 forms a cylindrical cavity or cylinder 12 extending along the axis 8 from a first axial end 12*a* to a second axial end 12*b*. Here, the cylinder 12 is formed as a cylindrical boring in the housing 11. A cylinder wall 18 formed by the housing 11 does not feature any additional machined portions on or in its inner surface, making the hydraulic unit 100 and/or the piston assembly 101 easy to manufacture.

Along the axis 8, the first axial direction 8*a* points from the first axial end 12*a* of the cylinder 12 to the second axial end 12*b* of the cylinder 12, and the second axial direction 8*b* points from the second axial end 12*b* of the cylinder 12 to the first axial end 12*a* of the cylinder 12. The piston 7 is disposed within the cylinder 12. A cylinder axis of the cylinder 12 coincides with the axis 8. The piston 7 is movable relative to the housing 11. Along the axis 8 the piston 7 extends from a first axial end 7*a* to a second axial end 7*b*. The piston 7 includes a cylindrical or at least partially cylindrical body portion 7*c* extending along the axis 8 and a protrusion 7*d* extending from the body portion 7*c* in a lateral direction perpendicular to the axis 8. Here, at least a section of the protrusion 7*d* has an annular shape. The protrusion 7*d* runs around the body portion 7*c*. In the embodiment depicted here, the body portion 7*c* and the protrusion 7*d* are formed in one piece. The piston 7 may be forced or moved in the first axial direction 8*a* by a hydraulic pressure in a first hydraulic chamber 25*a*, and the piston 7 may be forced or moved in the second axial direction 8*b* by a hydraulic pressure in a second hydraulic chamber 25*b*. The hydraulic chambers 25*a*, 25*b* are formed within the cylinder 12.

The piston assembly 101 further includes a first cap assembly 13*a* which closes or seals off the cylinder 12 at its first axial end 12*a*. The first cap assembly 13*a* includes an insertion portion 14*a* extending along the axis 8, and a cap portion 15*a* extending perpendicular to the axis 8. Here, the insertion portion 14*a* and the cap portion 15*a* are formed in one piece. The first cap assembly 13*a* is fixed to the housing 11, for example by a plurality of screws 16*a* (see FIG. 1). Here, the screws 16*a* extend parallel to the axis 8 and fix the cap portion 15*a* to the housing 11. The insertion portion 14*a* of the first cap assembly 13*a* is received in the cylinder 12. The first cap assembly 13*a*, more specifically the insertion portion 14*a* of the first cap assembly 13*a*, delimits the first hydraulic chamber 25*a* in the second axial direction 8*b*.

Here, the insertion portion 14*a* has the shape of a hollow cylinder. An outer radius of the insertion portion 14*a* is equal to or just slightly smaller than a radius of the cylinder 12. The piston assembly 101 further includes at least one first outer sealing member 17*a* such as a rubber or metal sealing ring. The first outer sealing member 17*a* is disposed radially in between the insertion portion 14*a* and the cylinder wall 18 enclosing the cylinder 12. The first outer sealing member 17*a* is mounted on the insertion portion 14*a*. More specifically, the first outer sealing member 17*a* is received in an outer indentation 19*a* formed in a radially outer surface of the insertion portion 14*a* of the first cap assembly 13*a*. The first outer sealing member 17*a* prevents fluid such as oil from leaking out of the cylinder 12.

The piston 7 or, more specifically, the body portion 7*c* of the piston 7 is partially received in the hollow cylindrical insertion portion 14*a* of the first cap assembly 13*a*. An inner radius of the hollow cylindrical insertion portion 14*a* is equal to or just slightly larger than a radius of the body portion 7*c* of the piston 7. The piston assembly 101 further includes at least one first inner sealing member 20*a* such as a rubber or metal sealing ring. The first inner sealing member 20*a* is disposed radially in between the hollow cylindrical insertion portion 14*a* and the body portion 7*c* of the piston 7. The first inner sealing member 20*a* is mounted on the insertion portion 14*a*. More specifically, the first inner sealing member 20*a* is received in an inner indentation 21*a* formed in a radially inner surface of the hollow cylindrical insertion portion 14*a* of the first cap assembly 13*a*. The first inner sealing member 20*a* prevents fluid such as oil from leaking into a hollow 22*a* formed axially in between the piston 7 and the cap portion 15*a* of the first cap assembly 13*a*.

The piston assembly 101 further includes a second cap assembly 13*b* which closes or seals off the cylinder 12 at its second axial end 12*b*. The second cap assembly 13*b* includes an insertion portion 14*b* extending along the axis 8, and a cap portion 15*b* extending perpendicular to the axis 8. Here, the insertion portion 14*b* and the cap portion 15*b* are formed in one piece. The second cap assembly 13*b* is fixed to the housing 11, for example by a plurality of screws which may extend parallel to the axis 8 and fix the cap portion 15*b* to the housing 11 (not shown). The insertion portion 14*b* of the second cap assembly 13*b* is received in the cylinder 12. The second cap assembly 13*b*, more specifically the insertion portion 14*b* of the second cap assembly 13*b*, delimits the second hydraulic chamber 25*b* in the first axial direction 8*a*.

Here, the insertion portion 14*b* has the shape of a hollow cylinder. An outer radius of the insertion portion 14*b* is equal to or just slightly smaller than a radius of the cylinder 12. The piston assembly 101 further includes at least one second outer sealing member 17*b* such as a rubber or metal sealing ring. The second outer sealing member 17*b* is disposed radially in between the insertion portion 14*b* and a cylinder wall 18 enclosing the cylinder 12. The second outer sealing member 17*b* is mounted on the insertion portion 14*b*. More specifically, the second outer sealing member 17*b* is received in an outer indentation 19*b* formed in a radially outer surface of the insertion portion 14*b* of the second cap assembly 13*b*. The second outer sealing member 17*b* prevents fluid such as oil from leaking out of the cylinder 12.

The piston 7 or, more specifically, the body portion 7*c* of the piston 7 is partially received in the hollow cylindrical insertion portion 14*b* of the second cap assembly 13*b*. An inner radius of the hollow cylindrical insertion portion 14*b* is equal to or just slightly larger than the radius of the body portion 7*c* of the piston 7. The piston assembly 101 further includes at least one second inner sealing member 20*b* such as a rubber or metal sealing ring. The second inner sealing member 20*b* is disposed radially in between a radially inner wall of the hollow cylindrical insertion portion 14*b* and the body portion 7*c* of the piston 7. The second inner sealing member 20*b* is mounted on the insertion portion 14*b*. More specifically, the second inner sealing member 20*b* is received in an inner indentation 21*b* formed in a radially inner surface of the hollow cylindrical insertion portion 14*b* of the second cap assembly 13*b*. The second inner sealing member 20*b* prevents fluid such as oil from leaking into a hollow 22*b* formed axially in between the piston 7 and the cap portion 15*b* of the second cap assembly 13*b*.

The zeroing member 110 is partially received in a recess 23 formed in the housing 11. Portions 11*a*, 11*b* of the housing 11 enclosing the recess 23 limit movement of the zeroing member 110 along the axis 8. More specifically, the portion 11*a* limits movement of the zeroing member 110 in the second axial direction 8*b*, and the portion 11*b* limits movement of the zeroing member 110 in the first axial direction 8*a*. The zeroing member 110 protrudes partially into the cylinder 12. Here, a length or extension of the recess 23 along the axis 8 and a length or extension of the zeroing member 110 along the axis 8 are such that a maximum stroke of the zeroing member 110 along the axis 8 within the recess 23 is at most 20 percent or at most ten percent of the axial length or of the axial extension of the recess 23. As can be seen in FIG. 3, a radially inner surface 110*c* of the zeroing member 110 has an arcuate shape adapted to the arcuate outer surface of the protrusion 7*d* of the piston 7.

In the embodiment depicted in FIGS. 1 to 8, the piston assembly 101 further includes a rotatable gudgeon 111 for adjusting a position of the zeroing member 110 along the axis 8. A rotation axis 111*a* of the gudgeon 111 is arranged perpendicular to the axis 8. The gudgeon 111 is received or at least partially received in the housing 11. The gudgeon is accessible from outside the housing 11. For example, the gudgeon 111 may include a feature 111*b* for receiving a tool such as an Allen key, a screw driver, or the like. Here, the rotatable gudgeon 111 includes a male threaded portion 111*c* which is received in a corresponding female threaded portion 11*c* formed in the housing 11. At an axial end of the gudgeon 111 facing the zeroing member 110, the gudgeon 111 includes an eccentric pin 112. The eccentric pin 112 extends parallel to and is spaced from the rotation axis 111*a* of the gudgeon 111 along the axis 8. The eccentric pin 112 is engaged with the zeroing member 110. More specifically, the eccentric pin 112 of the gudgeon 111 is received in a corresponding recess 110*a* formed in the zeroing member 110. For example, the eccentric pin 112 may be received in the recess 110*a* in a form-fit. The axial position of the zeroing member 110 may be adjusted by rotating or turning the gudgeon 111 with respect to its rotation axis 111*a*.

The first biasing member 9*a* biases or is configured to bias the piston 7 in the first axial direction 8*a* along the axis 8. In the embodiment depicted here, the first biasing member 9*a* is received on and encloses or at least partially encloses the piston 7. More specifically, the first biasing member 9*a* is received on and encloses or at least partially encloses the body portion 7*c* of the piston 7. Along the axis 8, the first biasing member 9*a* is supported on the first cap assembly 13*a*. Further, along the axis 8 the first biasing member 9*a* is supported on either the zeroing member 110 or the protrusion 7*d* of the piston 7 at all times. Or in other words, the first biasing member 9*a* is preloaded or at least partially compressed in between the first cap assembly 13*a* and either the zeroing member 110 or the protrusion 7*d* of the piston 7 at all times. More specifically, along axis 8 the first biasing member 9*a* is supported on the insertion portion 14*a* of the first cap assembly 13*a*. Or in other words, along the axis 8 the first biasing member 9*a* is supported on the housing 11 via the first cap assembly 13*a*.

Along the axis 8, the first biasing member 9*a* is disposed in between the first cap assembly 13*a* and the protrusion 7*d* of the piston 7. More specifically, along the axis 8 the first biasing member 9*a* is disposed in between the insertion portion 14*a* of the first cap assembly 13*a* and the protrusion 7*d* of the piston 7. Along the axis 8 the first biasing member 9*a* is disposed in between the first cap assembly 13*a* and the zeroing member 110. More specifically, along the axis 8 the first biasing member 9*a* is disposed in between the insertion portion 14*a* of the first cap assembly 13*a* and the zeroing member 110.

The piston assembly 101 further includes a first thrust ring 24*a*. Along the axis 8 the first thrust ring 24*a* is disposed in between the first biasing member 9*a* and the zeroing member 110 and in between the first biasing member 9*a* and the protrusion 7*d* of the piston 7. The first thrust ring 24*a* is received on the piston 7, more specifically on the body portion 7*c* of the piston 7. In the radial direction perpendicular to the axis 8, the first thrust ring 24*a* at least partially overlaps with the zeroing member 110. Or in other words, with respect to the axis 8 a maximum radius of the first thrust ring 24*a* determined perpendicular to the axis 8 is larger than a minimum radius of the zeroing member 110 determined perpendicular to the axis 8. Further, in the radial direction the first thrust ring 24*a* at least partially overlaps with the protrusion 7*d* of the piston 7. Or in other words, with respect to the axis 8 a minimum radius of the first thrust ring 24*a* determined perpendicular to the axis 8 is smaller than a maximum radius of the protrusion 7*d* determined perpendicular to the axis 8.

Thus, along the axis 8 the first biasing member 9*a* is configured to be supported on the protrusion 7*d* via the first thrust ring 24*a* and to move the piston 7*d* in the first axial direction 8*a* when or as long as the protrusion 7*d* extends or at least partially extends beyond the zeroing member 110 in the second axial direction 8*d* until the first thrust ring 24*a* hits or strikes against the zeroing member 110. A biasing force the first biasing member 9*a* exerts on the zeroing member 110 and a frictional force between the rotatable gudgeon 111 and the housing 11 are such that the first biasing member 9*a* may not move the zeroing member 110 along the axis 8 against the frictional force between the rotatable gudgeon 111 and the housing 11. In this way, the zeroing member 110 limits movement of the first biasing member 9*a* in the first axial direction 8*a*.

The second biasing member 9*b* biases or is configured to bias the piston 7 in the second axial direction 8*b* along the axis 8. In the embodiment depicted here, the second biasing member 9*b* is received on and encloses or at least partially encloses the piston 7. More specifically, the second biasing member 9*b* is received on and encloses or at least partially encloses the body portion 7*c* of the piston 7. Along the axis 8, the second biasing member 9*b* is supported on the second cap assembly 13*b*. Further, along the axis 8 the second biasing member 9*b* is supported on either the zeroing member 110 or the protrusion 7*d* of the piston 7 at all times. Or in other words, the second biasing member 9*b* is preloaded or at least partially compressed in between the second cap assembly 13*b* and either the zeroing member 110 or the protrusion 7*d* of the piston 7 at all times. More specifically, along axis 8 the second biasing member 9*b* is supported on the insertion portion 14*b* of the second cap assembly 13*b*. Or in other words, along the axis 8 the second biasing member 9*b* is supported on the housing 11 via the second cap assembly 13*b*.

Along the axis 8 the second biasing member 9*b* is disposed in between the second cap assembly 13*b* and the protrusion 7*d* of the piston 7. More specifically, along the axis 8 the second biasing member 9*b* is disposed in between the insertion portion 14*b* of the second cap assembly 13*b* and the protrusion 7*d* of the piston 7. Along the axis 8, the second biasing member 9*b* is disposed in between the second cap assembly 13*b* and the zeroing member 110. More specifically, along the axis 8 the second biasing member 9*b* is disposed in between the insertion portion 14*b* of the second cap assembly 13*b* and the zeroing member 110.

The piston assembly 101 further includes a second thrust ring 24*b*. Along the axis 8, the second thrust ring 24*b* is disposed in between the second biasing member 9*b* and the zeroing member 110 and in between the second biasing member 9*b* and the protrusion 7*d* of the piston 7. The second thrust ring 24*b* is received on the piston 7, more specifically on the body portion 7*c* of the piston 7. In the radial direction perpendicular to the axis 8, the second thrust ring 24*b* at least partially overlaps with the zeroing member 110. Or in other words, with respect to the axis 8 a maximum radius of the second thrust ring 24*b* determined perpendicular to the axis 8 is larger than a minimum radius of the zeroing member 110 determined perpendicular to the axis 8. Further, in the radial direction the second thrust ring 24*b* at least partially overlaps with the protrusion 7*d* of the piston 7. Or in other words, with respect to the axis 8 a minimum radius of the second thrust ring 24*b* determined perpendicular to the axis 8 is smaller than a maximum radius of the protrusion 7*d* determined perpendicular to the axis 8.

Thus, along the axis 8 the second biasing member 9*b* is configured to be supported on the protrusion 7*d* via the second thrust ring 24*b* and to move the piston 7*d* in the second axial direction 8*b* when or as long as the protrusion 7*d* extends or at least partially extends beyond the zeroing member 110 in the first axial direction 8*a* until the second thrust ring 24*b* hits or strikes against the zeroing member 110. A biasing force the second biasing member 9*b* exerts on the zeroing member 110 and a frictional force between the rotatable gudgeon 111 and the housing 11 are such that the second biasing member 9*b* may not move the zeroing member 110 along the axis 8 against the frictional force between the rotatable gudgeon 111 and the housing 11. In this way, the zeroing member 110 limits movement of the second biasing member 9*b* in the second axial direction 8*b*.

Figure 6:
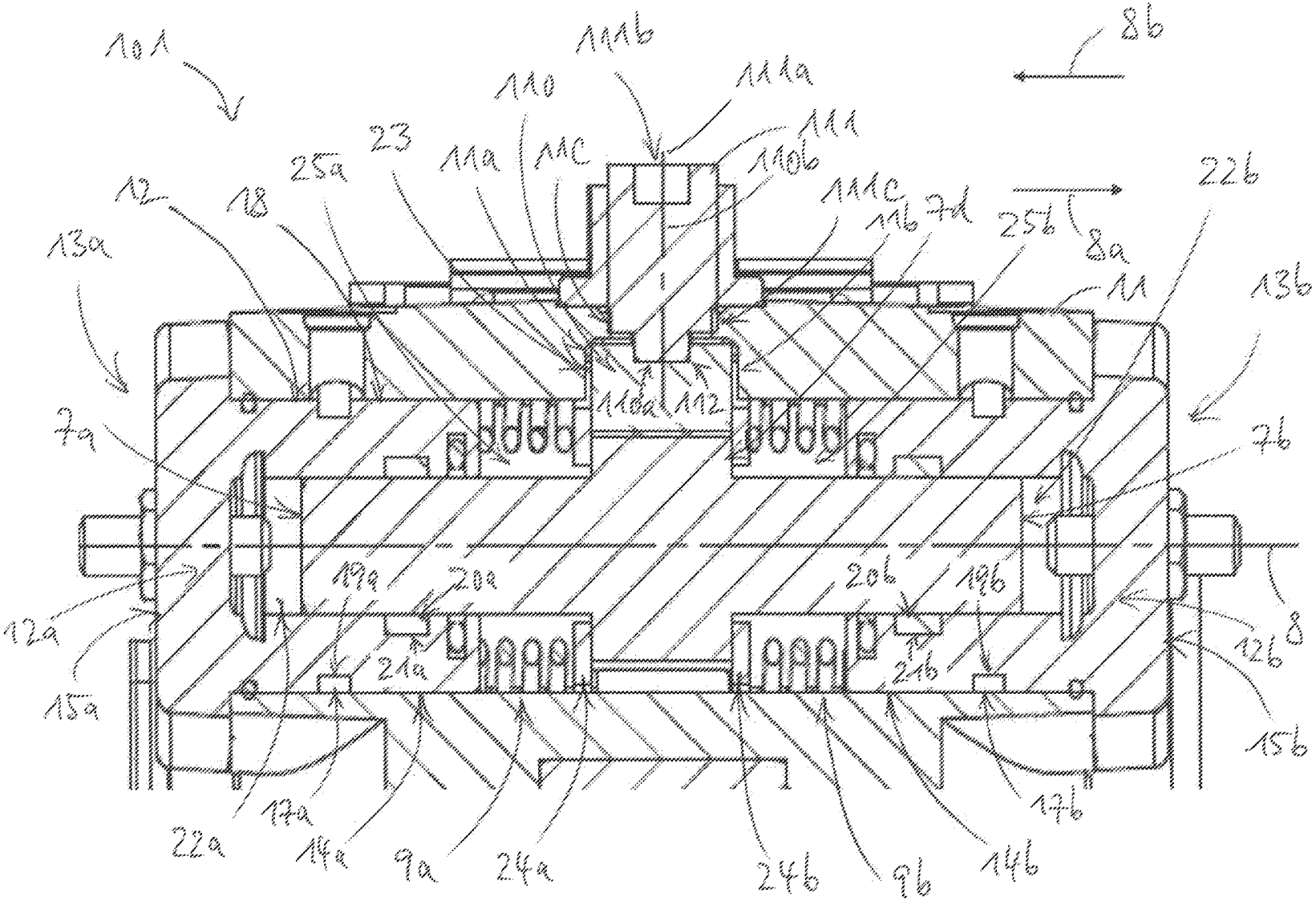
FIG. 6 illustrates the sectional view of FIG. 5, wherein the piston of the piston assembly has been moved back to the first zero position.

In FIGS. 5 and 6, the rotatable gudgeon 111 fixes the zeroing member 110 in a first position along the axis 8. For example, in the first position of the zeroing member 110 depicted in FIGS. 5 and 6, a center line 110*b* of the zeroing member 110 may coincide with the rotation axis 111*a* of the rotatable gudgeon 111. In FIG. 5, a hydraulic pressure in the first hydraulic chamber 25*a* is higher than a hydraulic pressure in the second hydraulic chamber 25*b* and deflects the piston 7 in the first axial direction 8*a* and away from a first zero position of the piston 7 set by the first position of the zeroing member 110, against a biasing force exerted on the piston 7 by the second biasing member 9*b* acting in the second axial direction 8*b*. In the deflected position of FIG. 5, the piston 7 at least partially compresses the second biasing member 9*b* in between the second thrust ring 24*b* and the second cap assembly 13*b*. At the same time, the first biasing member 9*a* presses the first thrust ring 24*a* against the zeroing member 110, the zeroing member 110 thereby limiting movement or further movement of the first biasing member 9*a* in the first axial direction 8*a*. In the deflected position of the piston 7 illustrated in FIG. 5, the piston 7 may swivel the swashplate 5 to a position such as the one shown in FIG. 4 where the swashplate 5 sets a stroke of the pistons 4 reciprocating within the cylinder block 3 to a non-zero value so that the hydraulic 100 is configured to displace fluid upon rotation of the shaft 2.

As, starting from the situation illustrated in FIG. 5, the hydraulic pressure in the first hydraulic chamber 25*a* is reduced to the hydraulic pressure in the second hydraulic chamber 25*b* so that no net hydraulic force acts on the piston 7 along the axis 8. The second biasing member 9*b* pushes the piston 7 in the second axial direction 8*b* until the second thrust ring 24*b* strikes against the zeroing member 110 so that the zeroing member 110 limits further movement of the second biasing member 9*b* in the second axial direction 8*b*.

The resulting situation is depicted in FIG. 6 where the biasing members 9*a*, 9*b* press the thrust rings 24*a*, 24*b* against the zeroing member 110 on opposing sides of the zeroing member 110 along the axis 8. Or in other words, in FIG. 6 the thrust rings 24*a*, 24*b* abut the zeroing member 110 on opposing sides of the zeroing member 110 along the axis 8. In this situation, the position of the protrusion 7*d* along the axis 8 is restricted to a space in between the thrust rings 24*a*, 24*b* set by the extension of the zeroing member 110 along the axis 8. Or in other words, in the first zero position of the piston 7 depicted in FIG. 6, the protrusion 7*d* overlaps with the zeroing member 110 along the axis 8. In the embodiment depicted here, a length or an extension of the protrusion 7*d* of the piston 7 along the axis 8 is equal to the extension of the zeroing member 110 along the axis 8. Consequently, the axial position of the zeroing member 110 set by the rotatable gudgeon 111 precisely sets the zero position of the piston 7 along the axis 8.

Figure 7:
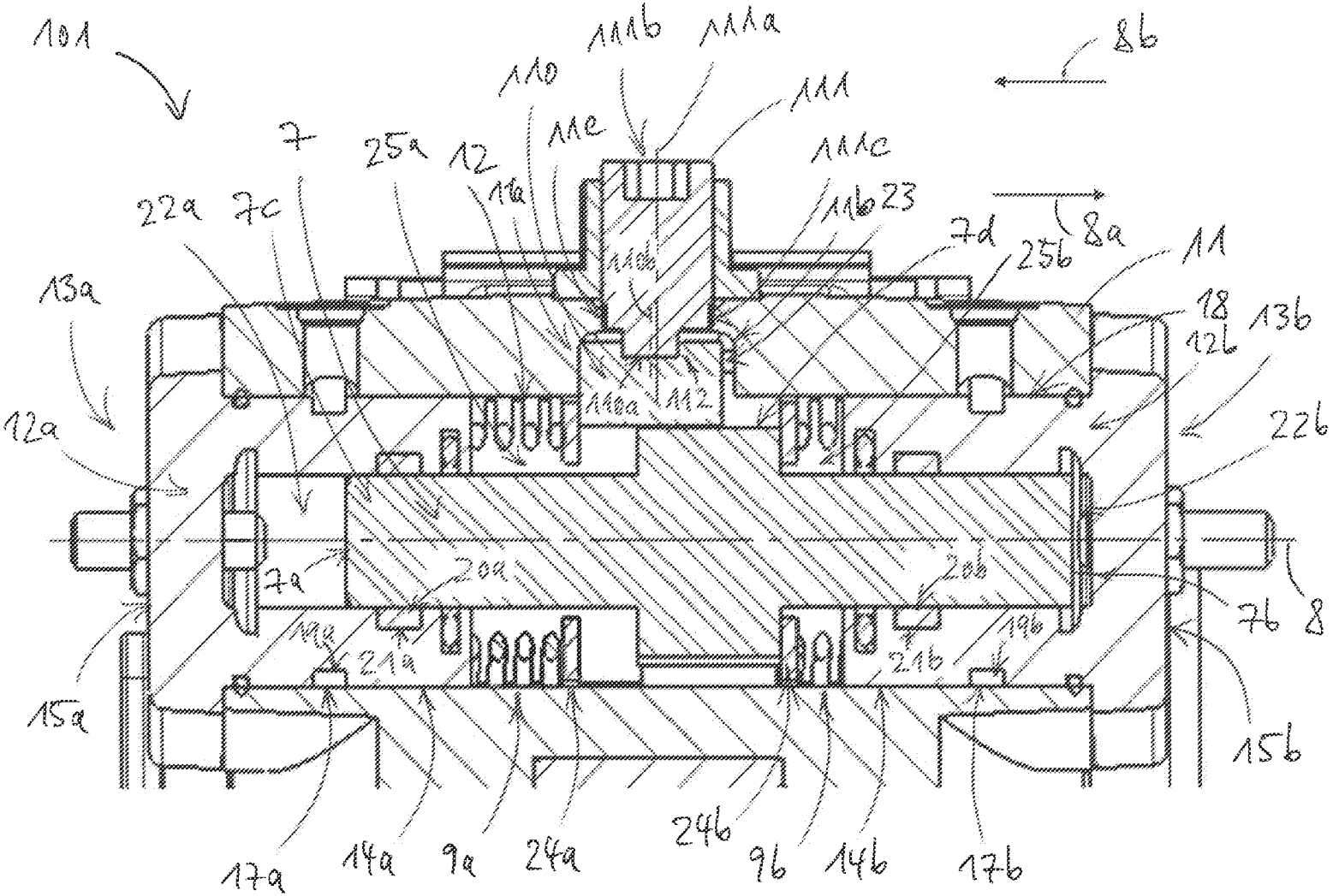
FIG. 7 illustrates a sectional view of the variable displacement hydraulic unit of FIGS. 1 to 4, wherein the piston of the piston assembly is deflected from a second zero position.
Figure 8:
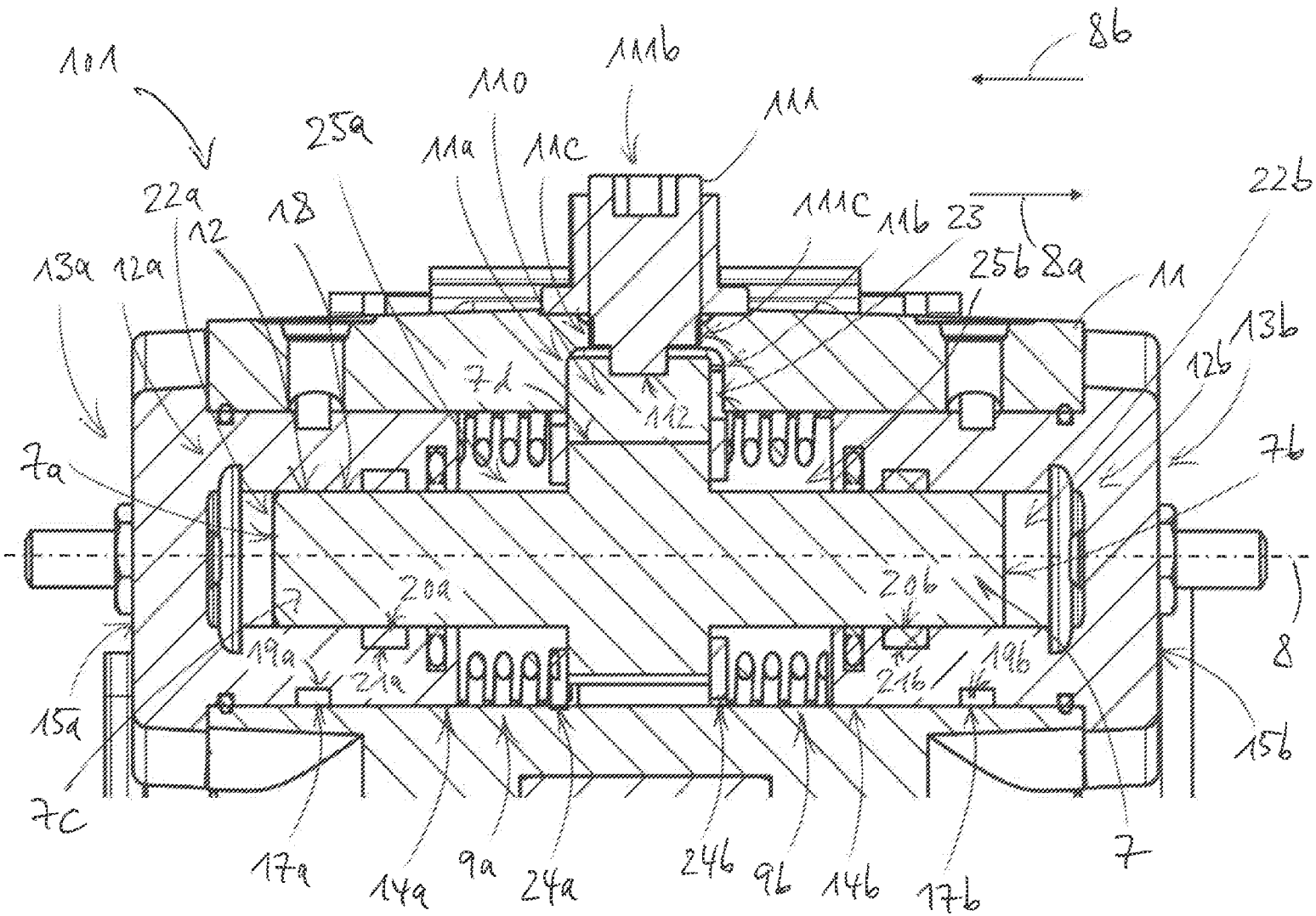
FIG. 8 illustrates the sectional view of FIG. 7, wherein the piston of the piston assembly has been moved back to the second zero position.

In FIGS. 7 and 8, the rotatable gudgeon 111 fixes the zeroing member 110 in a second axial position which is different from the first axial position of the zeroing member 110 depicted in FIGS. 5 and 6. As explained above, adjusting the axial position of the zeroing member 110 by turning the gudgeon 111 may be required to make sure that the zero position of the piston 7 along the axis 8 set or determined by the axial position of the zeroing member 110 corresponds to the neutral configuration of the hydraulic unit 100 with good accuracy. As a reminder, in the neutral configuration of the hydraulic unit 100 a stroke of the pistons 4 reciprocating in the cylinder block 3 vanishes. For example, in the second axial position of the zeroing member 110 depicted in FIGS. 7 and 8, the center line 110*b* of the zeroing member 110 is spaced from the rotation axis 111*a* of the rotatable gudgeon 111 along the axis 8.

Similar to the situations shown in FIGS. 5 and 6, FIG. 7 shows the piston 7 deflected from a second zero position of the piston 7 along the axis 8 set by the second axial position of the zeroing member 110. By contrast, in FIG. 8 no net hydraulic force acts on the piston 7 along the axis 8 and the biasing members 9*a*, 9*b* fix the piston 7 in the second zero position set by the second axial position of the zeroing member 110. Again, in FIG. 8 the position of the protrusion 7*d* along the axis 8 is restricted to a space in between the thrust rings 24*a*, 24*b* set by the extension of the zeroing member 110 along the axis 8. Or in other words, in the second zero position of the piston 7 depicted in FIG. 8, the protrusion 7*d* overlaps with the zeroing member 110 along the axis 8.

Figure 9:
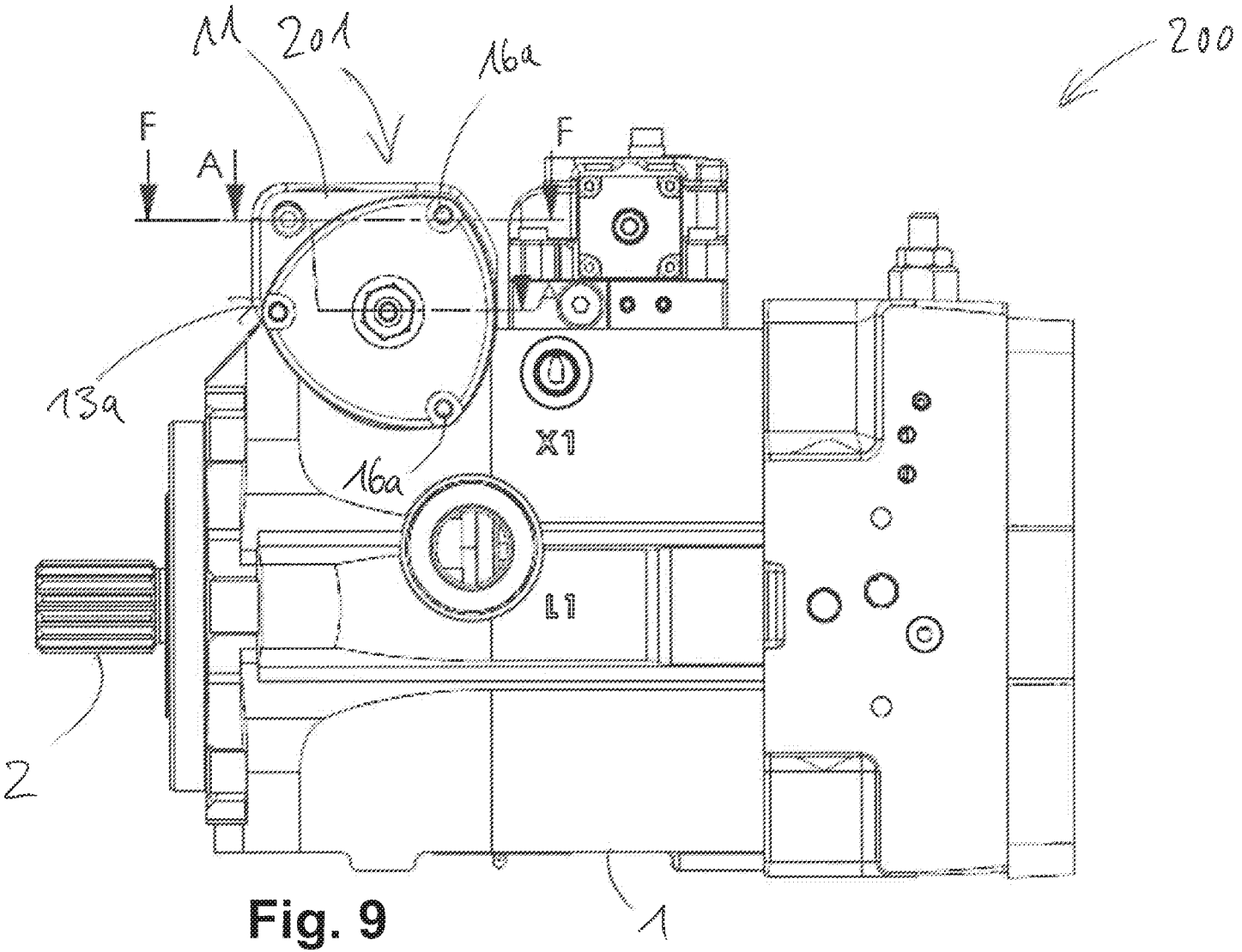
FIG. 9 schematically illustrates a plan view of a second embodiment of a variable displacement hydraulic unit including a piston assembly of the presently proposed type.
Figure 10:
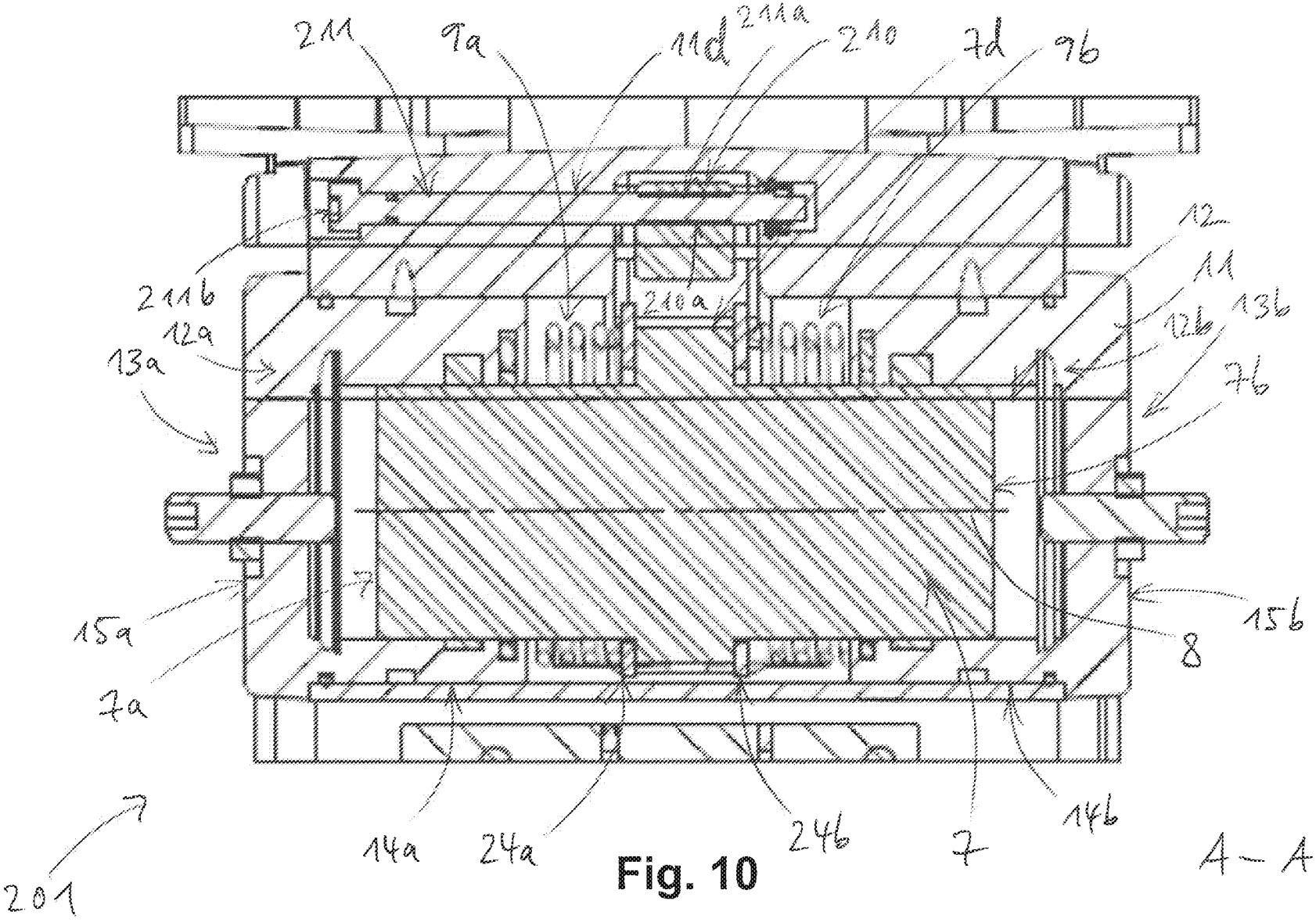
FIG. 10 schematically illustrates a first sectional view of the piston assembly of FIG. 9.
Figure 11:
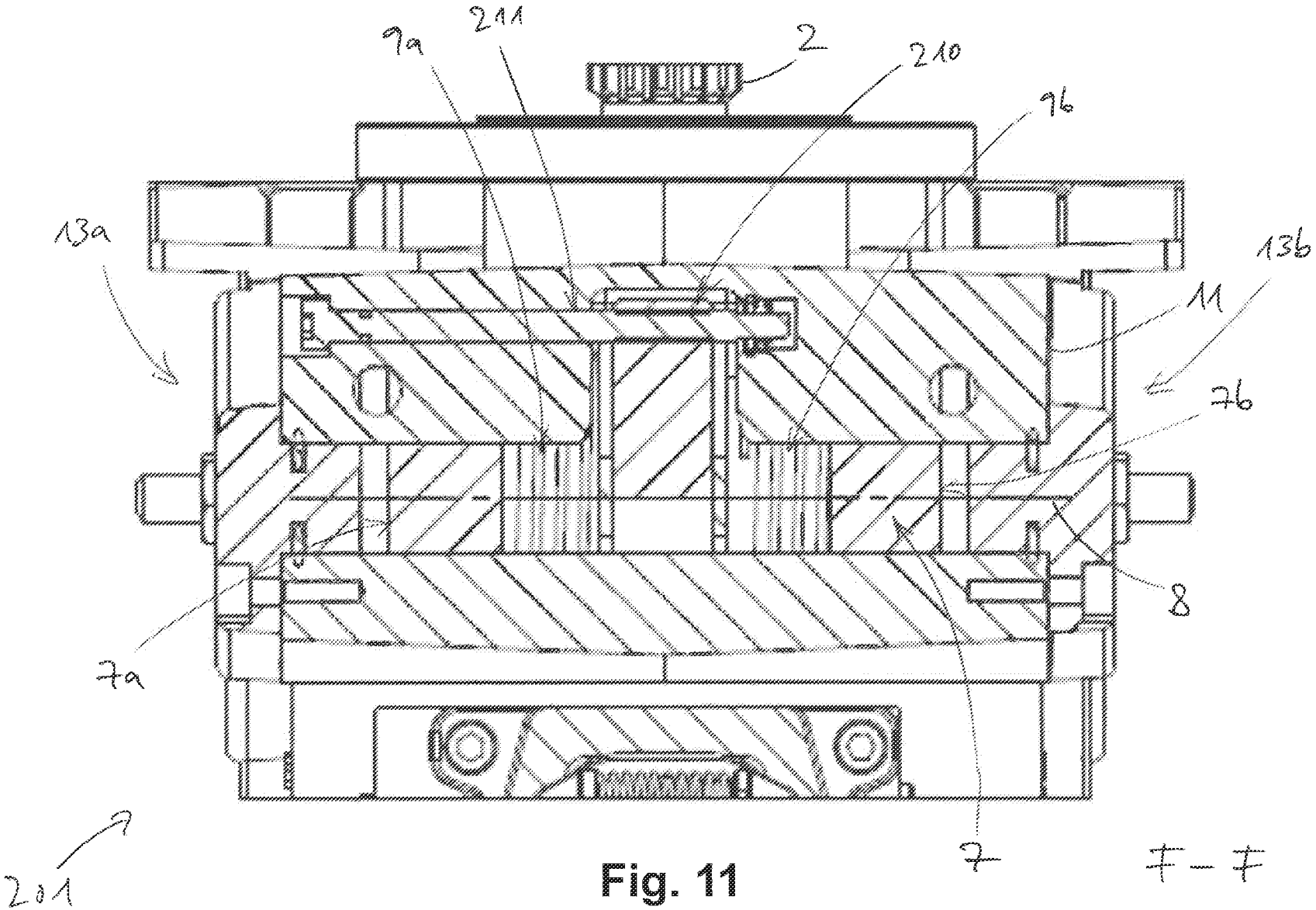
FIG. 11 schematically illustrates a second sectional view of the piston assembly of FIG. 9.
Figure 12:
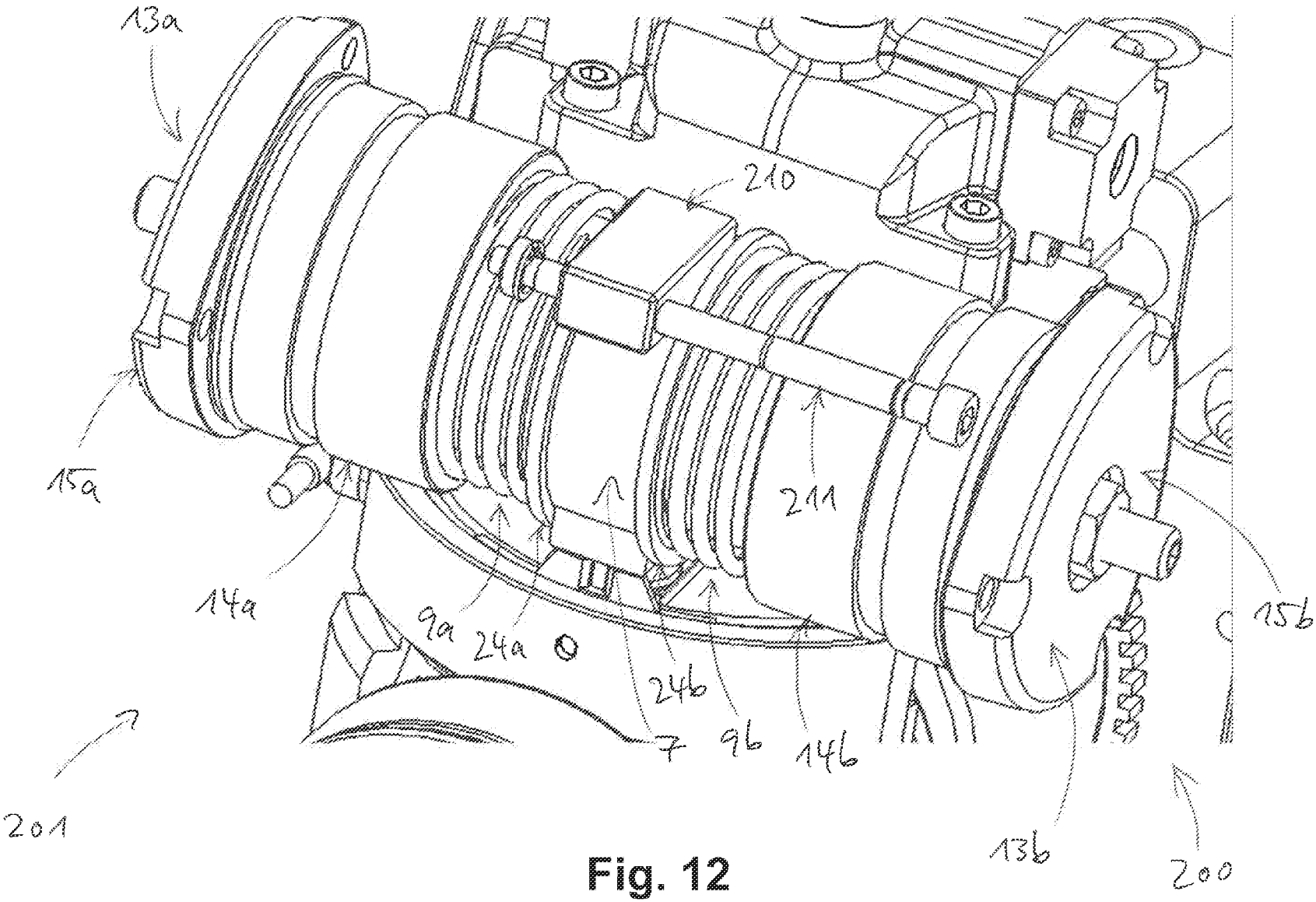
FIG. 12 schematically illustrates a perspective view of the piston assembly of FIG. 9.

FIGS. 9 to 12 show a variable displacement hydraulic unit 200 of the presently proposed type according to a second embodiment. The hydraulic unit 200 of FIGS. 9 to 12 is a variation of the hydraulic unit 100 of FIGS. 1 to 8. The hydraulic unit 200 is a variable displacement axial piston unit and may be used as a hydraulic pump or as a hydraulic motor. FIGS. 10 and 11 show different sectional views of the hydraulic unit 200 of FIG. 9. In FIG. 9, a straight dashed line A-A indicates the sectional plane of FIG. 10, and a step-like dashed line F-F indicates the section of FIG. 11. FIG. 12 shows a perspective view of elements of a piston assembly 201 of the hydraulic unit 200. As before, features recurring in different figures are designated with the same or similar reference signs.

Like the hydraulic unit 100 of FIGS. 1 to 8, the hydraulic unit 200 includes a casing 1, a rotatable shaft 2 such as pump shaft or motor shaft at least partially disposed in the casing 1, and a piston assembly 201. Further, the hydraulic unit 200 of FIGS. 9 to 12 typically includes a cylinder block rotationally coupled to the shaft, pistons configured to reciprocate within cylinders formed in the cylinder block, and a tiltable swashplate configured to control a stroke of the pistons (not shown), as is generally known in the art of hydraulic devices. Again, a rotation axis of the swashplate may be arranged perpendicular to the rotation axis of the rotatable shaft 2.

For the sake of brevity and simplicity, in the following only those features of the hydraulic unit 200 of FIGS. 9 to 12 which distinguish it from the hydraulic unit 100 of FIGS. 1 to 8 will be described in some detail. Unless explicitly stated otherwise, the hydraulic unit 200 of FIGS. 9 to 12 may include the same features as the hydraulic unit 100 of FIGS. 1 to 8. The differences between the hydraulic units 100 and 200 primarily concern differences between the piston assembly 101 of the hydraulic unit 100 and the piston assembly 201 of the hydraulic unit 200.

In contrast to the piston assembly 101 of the hydraulic unit 100 of FIGS. 1 to 8, the piston assembly 201 of the hydraulic unit 200 of FIGS. 9 to 12 includes a worm screw or lead screw 211 which is engaged with the zeroing member 210 of the piston assembly 201 so that the zeroing member 210 is displaceable along the axis 8 by rotating the worm screw or leadscrew 211. The worm screw or lead screw 211 includes a male threaded portion 211*a* which is engaged with a corresponding toothed portion 210*a* formed in the zeroing member 210. The worm screw or leadscrew 211 is arranged or extends parallel to the axis 8. The worm screw or leadscrew 211 is received in a cylindrical recess 11*d* formed in the housing 11. Along the axis 8 the worm screw or leadscrew 211 is fixed relative to the housing 11 in such a way that it does not move along the axis 8 when rotating. The worm screw or leadscrew 211 is accessible from outside the housing 11. For example, the worm screw or leadscrew 211 may include a feature 211*b* for receiving a tool such as an Allen key, a screw driver, or the like. Here, the worm screw or leadscrew 211 extends through the zeroing member 210.

FIGS. 1-12 are drawn to scale, although other relative dimensions may be used, if desired. FIGS. 1-12*ap* show example configurations with relative positioning of the various components. Unless otherwise noted, if shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure

The invention claimed is:

1. A piston assembly, comprising:

a cylinder extending along an axis and having an open axial end, a cap assembly closing the cylinder at its open axial end, the cap assembly comprising an insertion portion received in the cylinder at its open axial end, and a piston axially movably disposed within the cylinder and partially received in the insertion portion of the cap assembly;

a first biasing member for biasing the piston in a first direction along the axis, and an axially displaceable zeroing member limiting axial movement of the first biasing member; and a worm screw or leadscrew engaged with the zeroing member so that the zeroing member is displaceable along the axis by rotating the worm screw.

2. The piston assembly of claim 1, wherein a cylinder wall enclosing the cylinder has a cylindrical shape and includes no machined portion or portions in or on the cylinder wall.

3. The piston assembly of claim 1, wherein the cap assembly comprises an outer sealing member disposed radially in between the insertion portion of the cap assembly and a cylinder wall enclosing the cylinder, wherein the outer sealing member is mounted on the insertion portion of the cap assembly.

4. The piston assembly of claim 3, wherein a radially outer surface of the insertion portion of the cap assembly comprises an outer annular indentation, wherein the outer sealing member is received in the outer annular indentation.

5. The piston assembly of claim 1, wherein the cap assembly comprises an inner sealing member disposed radially in between the insertion portion of the cap assembly and the piston, wherein the inner sealing member is mounted on the insertion portion of the cap assembly.

6. The piston assembly of claim 5, wherein a radially inner surface of the insertion portion of the cap assembly comprises an inner annular indentation, wherein the inner sealing member is received in the inner annular indentation.

7. The piston assembly of claim 1, further comprising a hydraulic chamber formed axially in between the cap assembly and the piston, wherein a hydraulic pressure in the hydraulic chamber is configured to bias the piston in the first direction along the axis.

8. The piston assembly of claim 1, further comprising a housing, wherein the cylinder is formed in the housing and the cap assembly is fixed to the housing.

9. The piston assembly of claim 1, wherein the first biasing member is axially supported on the cap assembly.

10. The piston assembly of claim 1, further comprising a second biasing member for biasing the piston in a second direction along the axis, opposite the first direction, wherein the zeroing member limits axial movement of the first biasing member in the first direction along the axis and wherein the zeroing member limits axial movement of the second biasing member in the second direction along the axis, opposite to the first direction.

11. The piston assembly of claim 10, wherein the piston comprises a body portion and a protrusion extending from the body portion in a lateral direction perpendicular to the axis, wherein the first biasing member is configured to be axially supported on the protrusion and to bias the piston in the first direction along the axis when at least a portion of the protrusion extends beyond the zeroing member in the second direction along the axis, and wherein the second biasing member is configured to be axially supported on the protrusion and to bias the piston in the second direction along the axis when at least a portion of the protrusion extends beyond the zeroing member in the first direction along the axis.

12. The piston assembly of claim 11, wherein an axial extension of the protrusion is equal to an axial extension of the zeroing member.

13. The piston assembly of claim 11, further comprising:

a first thrust ring axially disposed in between the zeroing member and the first biasing member and in between the protrusion and the first biasing member so that the first biasing member is configured to be supported on the protrusion via the first thrust ring and to move the piston in the first direction until the first thrust ring hits the zeroing member, and a second thrust ring axially disposed in between the zeroing member and the second biasing member and in between the protrusion and the second biasing member so that the second biasing member is configured to be supported on the protrusion via the second thrust ring and to move the piston in the second direction until the second thrust ring hits the zeroing member.

14. The piston assembly of claim 10, wherein the first biasing member and/or the second biasing member at least partially enclose/encloses the piston.

15. A variable displacement hydraulic unit, comprising:

a swashplate, and the piston assembly of claim 1, wherein the piston is coupled to the swashplate for rotating the swashplate.

16. A piston assembly, comprising:

a cylinder extending along an axis and having an open axial end, a cap assembly closing the cylinder at its open axial end, the cap assembly comprising an insertion portion received in the cylinder at its open axial end, and a piston axially movably disposed within the cylinder and partially received in the insertion portion of the cap assembly;

a first biasing member for biasing the piston in a first direction along the axis, and an axially displaceable zeroing member limiting axial movement of the first biasing member; and a rotatable gudgeon including an eccentric pin engaged with the zeroing member so that the zeroing member is displaceable along the axis by rotating the rotatable gudgeon.

* * * * *